United States Patent [19]

Herbst

[11] 4,140,429

[45] Feb. 20, 1979

[54] CORROSION PROTECTED TENSIONING MEMBER FOR A PRESTRESSABLE ANCHOR IN SOLID ROCK

[75] Inventor: Thomas Herbst, Munich, Fed. Rep. of Germany

[73] Assignee: Dyckerhoff & Widmann Aktiengesellschaft, Munich, Fed. Rep. of Germany

[21] Appl. No.: 874,870

[22] Filed: Feb. 3, 1978

[30] Foreign Application Priority Data

Feb. 19, 1977 [DE] Fed. Rep. of Germany ..... 2707238

[51] Int. Cl.[2] ..... F21D 20/02

[52] U.S. Cl. ..... 405/261

[58] Field of Search ..... 61/39, 45 B, 63; 52/698

[56] References Cited

U.S. PATENT DOCUMENTS

| | | | |
|---|---|---|---|
| 3,306,051 | 2/1967 | Howlett | 61/45 B |
| 3,326,004 | 6/1967 | Williams | 61/45 B X |
| 3,379,019 | 4/1968 | Williams | 61/45 B |

FOREIGN PATENT DOCUMENTS

| | | | |
|---|---|---|---|
| 84937 | 1/1955 | Norway | 61/45 B |

*Primary Examiner*—Mervin Stein
*Assistant Examiner*—David H. Corbin
*Attorney, Agent, or Firm*—Frank L. Durr; Orville N. Greene

[57] ABSTRACT

A profiled tensioning rod or combination of rods is provided at the end which is to be inserted into the bore hole of a rock, with a corrosion protective tube formed in three parts, an anchoring part adapted to extend over the greater portion of the anchored end of the rod, a "free steel part" adapted to extend over the (initially) unconnected part of the anchoring rod which extends into the bore hole and a junction part to which the other two parts are connected. The junction part extends beyond the periphery of the other parts of the tube and is large enough to prevent any substantial flow of cement outwardly from the space between the anchoring part and the bore hole. The free steel part of the tube contains a deaerating conduit so that when the rock formation is stabilized after the various borings, etc., the free steel part of the bore hole may be cemented.

10 Claims, 4 Drawing Figures

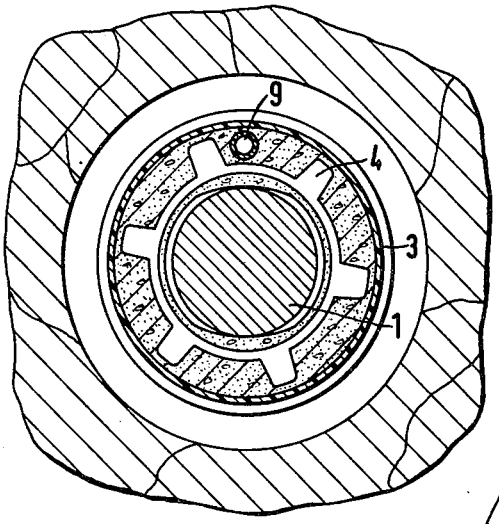
FIG. 2
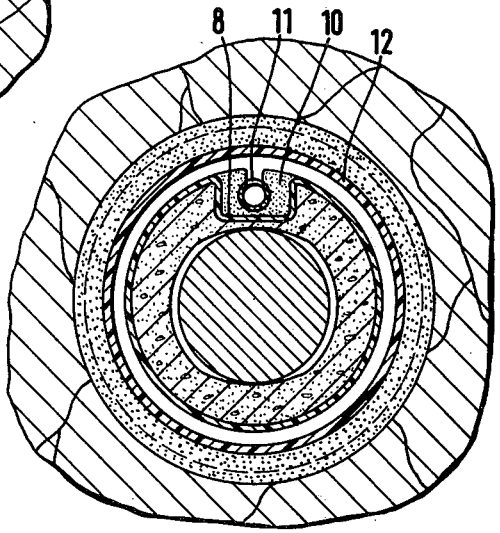
FIG. 3
FIG. 4
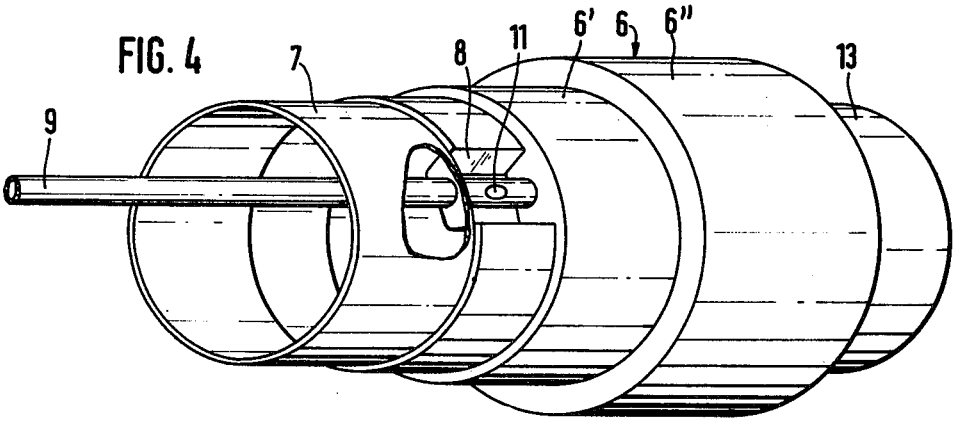

CORROSION PROTECTED TENSIONING MEMBER FOR A PRESTRESSABLE ANCHOR IN SOLID ROCK

The invention relates to a corrosion protected tensioning member for a prestressed anchor in solid rock, by which the connection between the tensioning member and the bore hole wall is produced by a synthetic resin adhesive or cement, e.g., a two component cement.

Earth and rock anchors have recently been used to an increasing extent as permanent construction components. By such means, building processes become possible, which permit far greater engagement in the material pockets and solid stone formations. An example of this is the leveling of large caverns in solid rock in which a reinforcement is required for the arched roof, and elm wood in order for it to be firm for a long time. This kind of reinforcement is constructed as rock anchors in connection with which the properties of the solid rock, the structure completion and the different loading states place special demands on these anchors. These demands exist with regard to anchors which must become effective in a short time, with regard to the adjusting in the course of the excavation of a cavern which sets up rock movement, with regard to an anchor tensionally connected to the rock along its entire length and above all, with regard to a durable and successful corrosion protection. Special difficulties also exist in that those anchors must be bored and built in, mostly on the excavations from above, also overhead.

This kind of anchor has an anchoring zone in which the tensioning member is fixed in the face of the mountain and an area, the so-called "free steel length" beyond which the tensioning member is free to expand and can be tensioned abreast the bore hole opening.

Anchors of this kind are known, whose anchoring regions are defined by a packing and are set with cement mortar. With them, the injection of the packing which is necessary in order to obtain a sealing of the bore hole and the molding of the anchoring zone is expensive. As a result of the long hardening time of cement mortar, these anchors can be tensioned at the earliest after one day, in addition to this a framework must often be installed. During the hardening of the cement mortar, the rock often undergoes undesirable loosening, as when inner tension is set free, or when vibrations produced by further blasting occur, which can be harmful for the effectiveness of the support of the rock span.

In order to protect the tensioning member of such an anchor from corrosion, which above all is of greatest importance in a water penetrating rock, anchors of this type must be protected against corrosion either immediately after tensioning through squeezing out the "free steel length" whereby to take the anchor out of service for a short time while the tensioning member in the region of the "free steel length" loses its expansibility, or to protect the tensioning member in the area of the "free steel length" against corrosion through coating, enveloping or the like, under retention of its expansibility. In this case, it is often difficult, if not almost impossible, to make the anchor at a later time, when no further displacements are feared, into a solid, integrated reinforcement in the rock.

These requirements for rock anchors lead to employment of synthetic resin cements or adhesives by which the steel rods, as tensioning members, are introduced into the deepest part of the bore hole and screwed into cartridges filled with synthetic resin cement and hardener. By screwing in such a steel rod, the cartridge is broken and the two components of the cement enclosed therein are mixed and the cement is set in less than a minute. With this, numerous cartridges in the anchoring zone with quick setting time, have been employed, together with cartridges with slower setting time in the free steel length, so that the tensioning members can be tensioned before the cement sets. In this way, the zone of free steel lengths are given protection against corrosion and a connection with the rock produced.

This kind of anchor often takes over the roll of a of a short time securing the joins forces with the above mentioned rock anchor. Since they are, nevertheless, obstructed anchors, they lack the possibility, over a long period of time, to elastically follow the movement of the mountain. By splitting of a fissure in the region of the anchor, the tensioning member can become locally overstrained and come to be in the breaking state.

This invention is based on the problem of preventing the drawbacks of the known anchors and to provide an anchor for solid stone which is permanently corrosion resistant and which, accordingly, can be quickly tensioned, which however in the area of its "free steel length" remains freely movable for a long time so that its tensioning force can be regulated, in which however, the possibility also exists of bonding the free steel length to the mountain at a later time.

The problem is solved according to the invention, by a corrosion protected tensioning member of the above mentioned art, wherein the tensioning member comprises one or more steel rods with a profiled surface arranged in a tube of corrosion resistant material within which a deaerating conduit extends from the air-sided end up to the junction place of the anchoring length and the free steel length at which place it has a deaerating opening open to the bore hole space, that the hollow space between the tensioning member and the tube is injected with hardening material, e.g. cement glue, and that at the junction place of the anchoring length and the free steel length, backing means for the synthetic resin cement is provided.

Further features of the invention will appear from the claims below.

The advantage of the tensioning member of the invention lies in the fact that over the total length of the tensioning member, double corrosion protection is obtained, through the tube of corrosion resistant material and the filling up of the hollow space between the tensioning member and the tube by cement mortar. By the invention, this hollow space filled mantle of cement is so thin, that it does not interfere with the extension of the tensioning member on tensioning. Some cracks appearing as the result of the low thickness of the mantle and the good connection with the tensioning member are so fine, that they do not influence the corrosion resistance. The mantle of cement is, however, on the other hand, so stable, that a satisfactory bonding to the tensioning member over this mantle, to the tube of corrosion resistant material and to the synthetic resin cement disposed to the rocks in the anchoring region, is obtained.

As a result of the good corrosion protection, the tensioning member of the invention can, after the tensioning which can take place immediately after the hardening of the resin cement, remain flexible in the bore hole. During this time, the tensioning can be continuously controlled, and the tensioning member be either after tensioned or relieved until the rock has come to rest. If no furtherrock movement is to be suspected, a bonding in the region of the free steel length between the tube of the tensioning member and the bore hole wall can be brought about through injection of cement glue. A satisfactory injection of the bore hole space is possible through deaerating with the aid of the integral deaerating conduit, which is protected against possible penetration of synthetic resin cement from the anchoring region. Consequently, in the final state, a so-called obstructed anchor as reinforcement of the rock is possible.

In the drawing:

FIG. 2 is a sectional view taken along line II—II of FIG. 1.

FIG. 3 is a sectional view taken along line III—III of FIG. 1, and

FIG. 4 is a perspective showing of the backing support attachment with inserted deaerating conduit.

Figure 1:
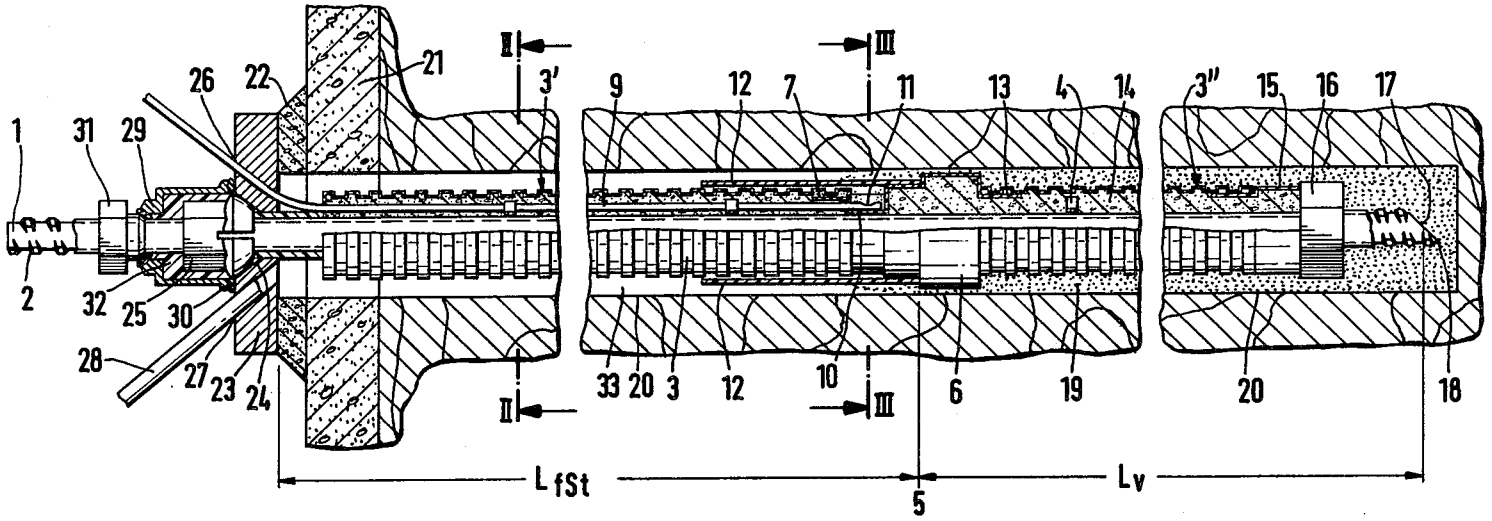
FIG. 1 is a longitudinal section through an anchor made according to the invention.

In the example of FIG. 1, a tensioning member of a steel rod 1, having hot rolled ribs 2 forming a spiral thread thereon, is surrounded by a ribbed sheath tube 3, preferably of plastic, in which said rod 1 is held centrally thereof by means of spacers 4. The sheath tube 3 comprises two parts, a part 3', which extends on the "free steel length" $L_{fst}$ from the air side up to the junction point 5 between the free steel length and the anchoring length $L_v$ and a part 3" which reaches from the junction point 5 over the anchoring length $L_v$ to the other end of the steel rod 1. Between the two parts 3' and 3" of the sheath tube 3, backing attachment 6 is arranged on which the two parts 3' and 3" of the sheath tube are fastened.

The backing attachment 6 is shown in an enlarged view in FIG. 4. It comprises in conformity with the art, a jacket formed hollow body which on the air side end has a projection 7 which can be inserted into the part 3' of the ribbed tube sheath tube 3. Adjacent this place, a pocket 8 is formed at one side in which the deaerating tube 9 is inserted, which reaches from the free end of the steel length, $L_{fst}$, of the steel rod 1 up to the air sided end of the rod. The deaerating conduit 9 is fastened in this pocket by synthetic resin; it has in the region of the pocket 8 an outwardly directed deaerating opening 11. The deaerating opening 11 is covered by a transfer or deflecting tube 12 (see FIG. 1) which surrounds a certain length of the sheath tube 3 and is pushed over a cylindrical region 6' of the backing support attachment 6. In the "middle region 6", the backing support 6 has a somewhat greater diameter and a projection 13 is formed on the front side in which the part 3" of the sheath tube 3 is shoved.

The hollow space between the tension member 1 and the sheath tube 3, that is, its parts 3' and 3", as well as the backing attachment 6 has already been filled with cement mortar 14 before the installation of the tensioning member 1 which has been injected in the hollow space remaining. For the purpose of the injection, the sheath tube 3" is closed on the earth side end by an injection cap 15 — remaining on the tension member — which has an injection nipple (not shown) to which an injection tube can be connected. On the air side end, a corresponding injection cap with a deaerating opening is provided for the injecting process, which on the assembling of the tensioning member is again removed. At the earth side end of the tensioning member 1, a mixing arrangement in the form of a threaded nut 16 is screwed thereon. The end 17 of the tensioning member 1 is cut obliquely in order to form a point 18.

The assembled tensioning member 1 so constructed and protected against corrosion, is introduced in the bore hole in which previously one or more cartridges containing synthetic resin and a hardener have been planted. The cartridges themselves, for the sake of simplicity, have not been shown. By introducing the tensioning member 1, the cartridges are broken by means of the point 18. By the ensuing screwing in of the tensioning members, whereby the round cross-sectional sheath tube 3 offers no resistance against rotation, the resin cement and hardener from the broken cartridges are thoroughly mixed in the deepest part of the bore hole by means of the polygonal periphery of the nut 16. Thereby a homogeneous synthetic resin cement mass is formed which always, after passage of the hardening time, quickly hardens. With this, it is essential that between the bore hole wall and the sheath tube part 3", the smallest possible annular clearance remains by which means a secure mixing of the cement with the hardener is obtained. The creep phenomena is not so strongly pronounced in a thick adhesive layer.

Through the backing means 6 at the junction region of the "free steel length" to the anchoring length, the dislodged cement is retarded from passing from the anchoring length to the region of the free steel length and at the same time, that remaining resin cement in the region of the anchoring length sets under pressure and is forced against the bore hole wall 20. Any cement which escapes from the backing device 6, remains in the region between the transfer or deflecting tube 12 and the bore hole wall 20.

Immediately after hardening of the cement 19, the tensioning member 1 can be stressed. For this purpose, an abutment plate 23 on a mortar bed 22, is arranged at the air side end over an equalizing layer 21, e.g., of concrete. The abutment plate 23 has a conical boring 24 through which the tensioning member 1 passes. The tensioning member 1 can be seized at the air-side end in the known way by a tensioning press and be stressed. The stressing force is then transmitted through an anchor nut 25 acting on the abutment plate 23. The deaerating conduit 9 is passed to the outside through a bore 26 in the abutment plate 23. Through another bore 27, an injecting conduit 28 is conducted, which leads to the space between the tube part 3', and the bore wall 20 in the area of the free steel length.

During the time during which the anchor remains freely extensible in the region of the free steel length, the anchoring nut 25 is sealed by means of a protective cap 29 which, under the interposition of a packing 30, will be pressed by means of a nut 31 on the anchor plate 23. The hollow space between the closing cap 29 and the anchoring nut 25 is filled with corrosion resistant paste 32. After taking off the closure cap 29, the anchoring nut 25 is always accessible.

When after installing in a rock location, no further rock movement can be expected, the remaining space 33 between the tube part 3' and the bore hole wall 20, can be filled in through the injection conduit 29. Thereby, the air enclosed within the hollow space 33 is pressed to the outside. It can penetrate in the space between the transfer tube 12 and the sheath tube 3 and escape to the outside over the deaerating opening 11 and the conduit 9.

By this means, by which the deaerating conduit 9 is led into the sheath tube 3, the latter forms with their circular circumference, the outer limit of the tensioning member screwed into the bore hole and opposed only an exceedingly low resistance to the screwing in step. The deaerating conduit 9 is consequently protected against eventual damage.

I claim:

1. In a corrosion-protected tension member for anchoring and prestressing in a bore hole having a closed end and an air side end such as formed in solid rock, of the type wherein the anchoring end of the tension member comprises an anchoring length adjacent the end thereof and a free steel length adjacent the anchoring length adapted to extend to the air side of a bore hole and wherein the bonding between the anchoring length of the tension member and the bore hole is established by means of synthetic resin, the combination comprising profiled tensioning means comprising at least one steel rod a tube of corrosion resistant material extending around the free steel length and most of the anchoring length of said profiled tensioning means, said tube comprising a free steel part, and anchoring part and a shoulder junction part connecting to the free steel part and to the anchoring part thereof and being approximately concentrically spaced around the tensioning means the spaces between the tube and the profiled tensioning member being injected with hardenable adhesive, said free steel part of said tube containing a deaerating conduit extending from the junction part along the free steel part to the opposite end thereof, said deaerating conduit having an opening adjacent said junction part which opens to the outer side of said tube.

2. The corrosion protected tension member as claimed in claim 1 wherein said shouldered junction part of said tube comprises a hollow body having a central bulging portion and tubular portions extending in opposite directions therefrom to connect to the free steel part and anchoring part of said tube, respectively.

3. The corrosion protected tension member as claimed in claim 1 wherein said shouldered junction part has a pocket at one side adjacent the tubular portion for connecting to the free steel part which pocket is open to the outside of said tube and which is adapted to receive the end of the deaerating conduit which contains the opening.

4. The corrosion protected tension member as claimed in claim 3 wherein said shouldered junction part comprises tubular diverting means adapted to prevent resin leaking from the anchoring part of a bore hole from contacting said opening in the deaerating conduit.

5. The corrosion protected tension member as claimed in claim 1 wherein said free steel and said anchoring parts of said tube are ribbed and of approximately circular cross-sectional shape.

6. The corrosion protected tension member as claimed in claim 1 wherein said profiled tensioning means extends beyond the end of the anchoring part of said tube and comprises means for breaking a cartridge of synthetic resin cementing material which has been inserted in the bore hole.

7. The corrosion protected tension member as claimed in claim 6 wherein the means for breaking a cartridge comprises a pointed end of the profiled tensioning means.

8. The corrosion protected tensioning member as claimed in claim 6 wherein the pointed end of the profiled tensioning member is formed by an oblique cut of the end of said member.

9. The corrosion protected tension member as claimed in claim 6 comprising means adjacent the end of said profiled tensioning means for mixing a cementing composition when such a composition is released from a broken cartridge.

10. The corrosion protected tension member as claimed in claim 9 wherein said profiled tensioning means comprises a rod with hot rolled ribs thereon which are spirally arranged to form a screw thread, said means for mixing comprising a nut with a polygonal periphery screwed onto said profiled tensioning means.

* * * * *